US010377588B2

(12) United States Patent
Konishi

(10) Patent No.: US 10,377,588 B2
(45) Date of Patent: Aug. 13, 2019

(54) SHEET STORAGE CASSETTE AND IMAGE FORMING APPARATUS INCLUDING SAME

(71) Applicant: KYOCERA Document Solutions Inc., Osaka (JP)

(72) Inventor: Hirohito Konishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/923,509

(22) Filed: Mar. 16, 2018

(65) Prior Publication Data

US 2018/0273313 A1 Sep. 27, 2018

(30) Foreign Application Priority Data

Mar. 21, 2017 (JP) ..... 2017-054180

(51) Int. Cl.
*B65H 1/04* (2006.01)
*B65H 1/08* (2006.01)
*B65H 1/26* (2006.01)

(52) U.S. Cl.
CPC ..... *B65H 1/04* (2013.01); *B65H 1/08* (2013.01); *B65H 1/266* (2013.01); *B65H 2405/114* (2013.01); *B65H 2511/12* (2013.01)

(58) Field of Classification Search
CPC ..... B65H 1/04; B65H 9/00; B65H 2403/40; B65H 2405/114; B65H 2405/1144; B65H 2511/00; B65H 2511/10; B65H 2511/11; B65H 2511/12; B65H 2403/41
USPC ..... 271/171
See application file for complete search history.

(56) References Cited

U.S. PATENT DOCUMENTS 7,694,958 B2 * 4/2010 Nakamura ..... G03G 15/6502 271/145
2014/0234000 A1 8/2014 Taniguchi ..... 399/388
2017/0121138 A1 * 5/2017 Koga ..... B65H 1/04

FOREIGN PATENT DOCUMENTS

JP 2014-162562 A 9/2014

* cited by examiner

*Primary Examiner* — Prasad V Gokhale
(74) *Attorney, Agent, or Firm* — Stein IP, LLC

(57) ABSTRACT

A sheet storage cassette of the present disclosure includes a sheet storage portion, a rack and a cursor. The cursor aligns sheets. The cursor includes a regulation portion which makes contact with the side ends of the sheets and a lock portion which includes at least one engagement protrusion that engages with the rack teeth of the rack. The at least one engagement protrusion each includes a second inclination surface which is inclined from a tip end portion toward a base portion in a second direction opposite to a first direction. At least one of the engagement protrusions includes a second vertical surface which is extended vertically downward from the base portion toward the tip end portion. At least one of the engagement protrusions includes a third inclination surface which is inclined in the second direction and which is extended to the tip end portion of the engagement protrusion.

9 Claims, 6 Drawing Sheets

SHEET STORAGE CASSETTE AND IMAGE FORMING APPARATUS INCLUDING SAME

INCORPORATION BY REFERENCE

This application is based upon and claims the benefit of priority from the corresponding Japanese Patent Application No. 2017-054180 filed on Mar. 21, 2017, the entire contents of which are incorporated herein by reference.

BACKGROUND

The present disclosure relates to a sheet storage cassette which is used in an image forming apparatus such as a digital copying machine or a laser printer and which stores sheets and an image forming apparatus which includes such a sheet storage cassette.

Conventionally, a paper feed cassette (sheet storage cassette) is widely used which stores a plurality of sheets stacked in layers and which separates and transports the sheets to an image formation portion in the main body of an image forming apparatus one by one according to an image formation operation.

As the paper feed cassette described above, a paper feed cassette is known where a sheet storage portion which stores sheets, a sheet stacking plate which is arranged in the sheet storage portion and in which the sheets are stacked on the upper surface, a rack which is formed on the bottom surface portion of the sheet storage portion and which is extended along a paper feed direction and a back end cursor which can be moved along the rack and which makes contact with the back ends (end edge) of the sheets so as to align the sheets are provided.

In the rack, a plurality of rack teeth arranged with a predetermined pitch in the paper feed direction are provided, and in the back end cursor, a plurality of engagement protrusions which engage with the rack teeth and a lever portion which is operated so as to move the engagement protrusions upward are provided. In a state where the lever portion is operated, the back end cursor is brought into contact with the back ends of the sheets, thereafter the operation of the lever portion is cancelled and thus the engagement protrusions engage with the rack teeth such that the movement of the cursor is regulated. In this way, the back ends of the sheets are aligned in a predetermined position.

SUMMARY

A sheet storage cassette according to a first aspect of the present disclosure can be inserted and removed with respect to a cassette fitting portion in the main body of an apparatus. The sheet storage cassette includes a sheet storage portion, a sheet stacking plate, a rack and a cursor. The sheet storage portion stores sheets. The sheet stacking plate is provided in the sheet storage portion so as to be pivoted with a portion on the upstream side in a sheet feeding direction serving as a support point, and the sheets are stacked on the upper surface. The rack is provided on the bottom surface of the sheet storage portion and is extended along a first direction. The cursor can be moved along the rack and makes contact with the end edge of the sheets in the first direction so as to align the sheets. The rack includes rack teeth which are continuously provided with a predetermined pitch in the first direction, and each of the rack teeth includes a first vertical surface which is extended vertically upward from a tooth bottom toward a tooth tip and a first inclination surface which is inclined from the tooth tip toward the tooth bottom in the first direction. The cursor includes a cursor main body, a regulation portion which makes contact with the end edge of the sheets and a lock portion provided on the lower surface of the cursor main body, the lock portion includes at least one engagement protrusion that engages with the rack teeth and which regulates the movement of the cursor. The at least one engagement protrusion each includes a second inclination surface which is inclined from a tip end portion toward a base portion in a second direction opposite to the first direction. At least one of the at least one engagement protrusion includes a second vertical surface which is extended vertically downward from the base portion toward the tip end portion. The second vertical surface engages with the first vertical surface such that the movement of the cursor in the first direction is regulated. At least one of the at least one engagement protrusion includes a third inclination surface which is inclined in the second direction and extended to the tip end portion of the at least one engagement protrusion.

Further other objects of the present disclosure and specific advantages obtained by the present disclosure will become more apparent from the description of embodiments given below.

DETAILED DESCRIPTION

Embodiments of the present disclosure will be described below with reference to drawings.

First Embodiment

Figure 1:
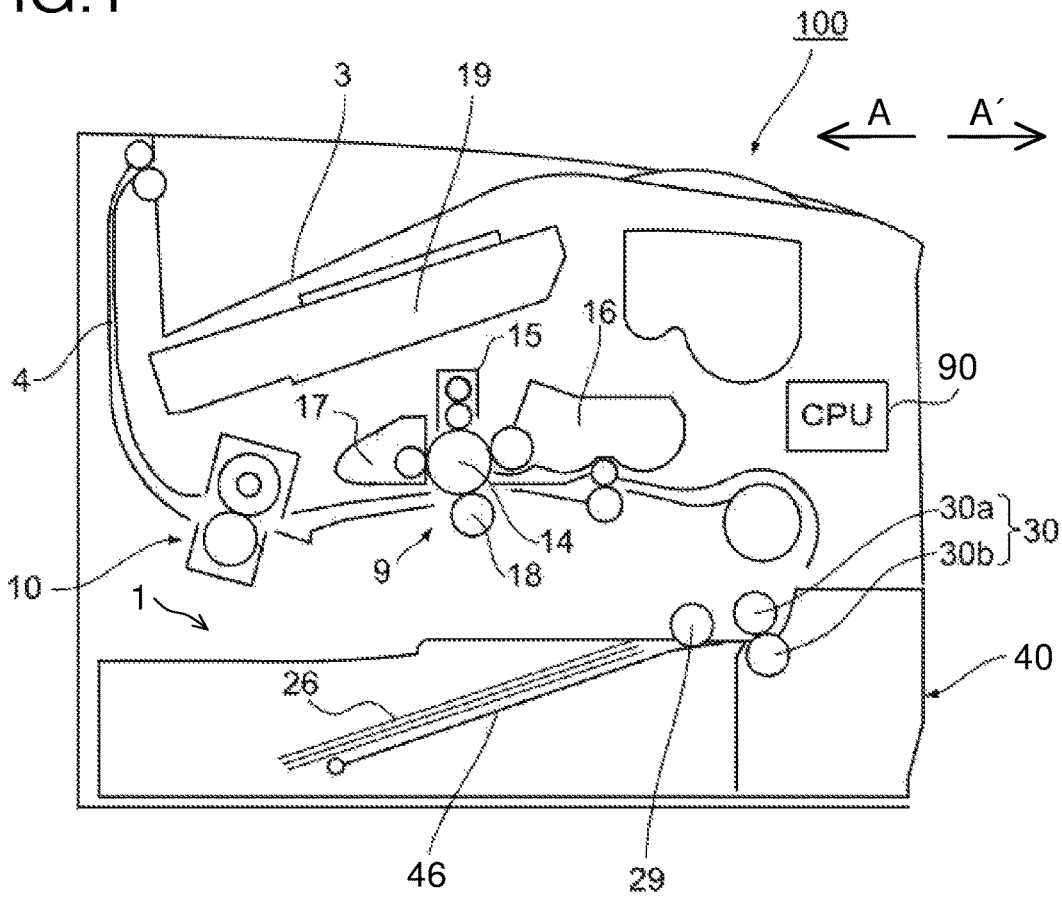
FIG. 1 is a schematic view showing an internal configuration of an image forming apparatus in which a paper feed cassette according to a first embodiment of the present disclosure is incorporated.

FIG. 1 is a schematic view showing an internal configuration of an image forming apparatus 100 in which a paper feed cassette 40 according to a first embodiment of the present disclosure is incorporated, and shows with the assumption that the right side is the front side of the image forming apparatus 100. As shown in FIG. 1, the image forming apparatus 100 (here, a monochrome printer) includes the paper feed cassette (sheet storage cassette) 40 which stores sheets 26 stacked in a lower portion of the main body of the image forming apparatus 100. Above the paper feed cassette 40, a sheet transport path 4 is formed which is extended substantially horizontally from the front to the back of the main body of the image forming apparatus 100 and which is further extended upward so as to reach a paper ejection portion 3 formed in the upper surface of the main body of the image forming apparatus 100, and along the sheet transport path 4, sequentially from the upstream side, a pickup roller 29, a feed roller 30*a*, an intermediate transport roller, a registration roller pair, an image formation portion 9, a fixing device 10 and an ejection roller pair are arranged. Furthermore, within the image forming apparatus 100, a control portion (CPU) 90 is arranged which controls the operations of the individual rollers described above, the image formation portion 9, the fixing device 10 and the like.

In the paper feed cassette 40, a sheet stacking plate 46 is provided which is turnably supported with respect to the paper feed cassette 40 by a turning support point provided on the upstream side in a sheet feeding direction, and the sheets 26 stacked on the upper surface of the sheet stacking plate 46 are pressed by the pickup roller 29. In the front side of the paper feed cassette 40, a paper feed roller pair 30 is provided which is formed with the feed roller 30*a* and a retard roller 30*b* arranged so as to be pressed to the feed roller 30*a*. When a plurality of sheets 26 are simultaneously fed by the pickup roller 29, the sheets 26 are separated by the feed roller 30*a* and the retard roller 30*b* such that only the uppermost sheet is transported.

The image formation portion 9 forms a predetermined toner image on the sheet 26 by an electrophotographic process, and is formed with: a photosensitive drum 14 which is an image carrying member that is supported with a shaft so as to be able to be rotated in a clockwise direction in FIG. 1; a charging device 15, a development device 16, a cleaning device 17 and a transfer roller 18 that is arranged opposite the photosensitive drum 14 through the sheet transport path 4, which are arranged around the photosensitive drum 14; and an exposure device (LSU) 19 which is arranged above the photosensitive drum 14.

When image data is input from a higher device such as a personal computer, the surface of the photosensitive drum 14 is first charged uniformly by the charging device 15. Then, by a laser beam from the exposure device (LSU) 19, an electrostatic latent image based on the image data input is formed on the photosensitive drum 14. Furthermore, a toner is adhered by the development device 16 to the electrostatic latent image, and thus a toner image is formed on the surface of the photosensitive drum 14. The toner image formed on the surface of the photosensitive drum 14 is transferred by the transfer roller 18 to the sheet 26 which is supplied into a nip portion (transfer position) between the photosensitive drum 14 and the transfer roller 18.

The sheet 26 to which the toner image is transferred is separated from the photosensitive drum 14, is transported toward the fixing device 10 and is heated and pressurized by a heating roller and a pressure roller provided in the fixing device 10, and thus the toner image transferred to the sheet 26 is fixed. Then, the sheet 26 is ejected by the ejection roller pair to the paper ejection portion 3.

Figure 2:
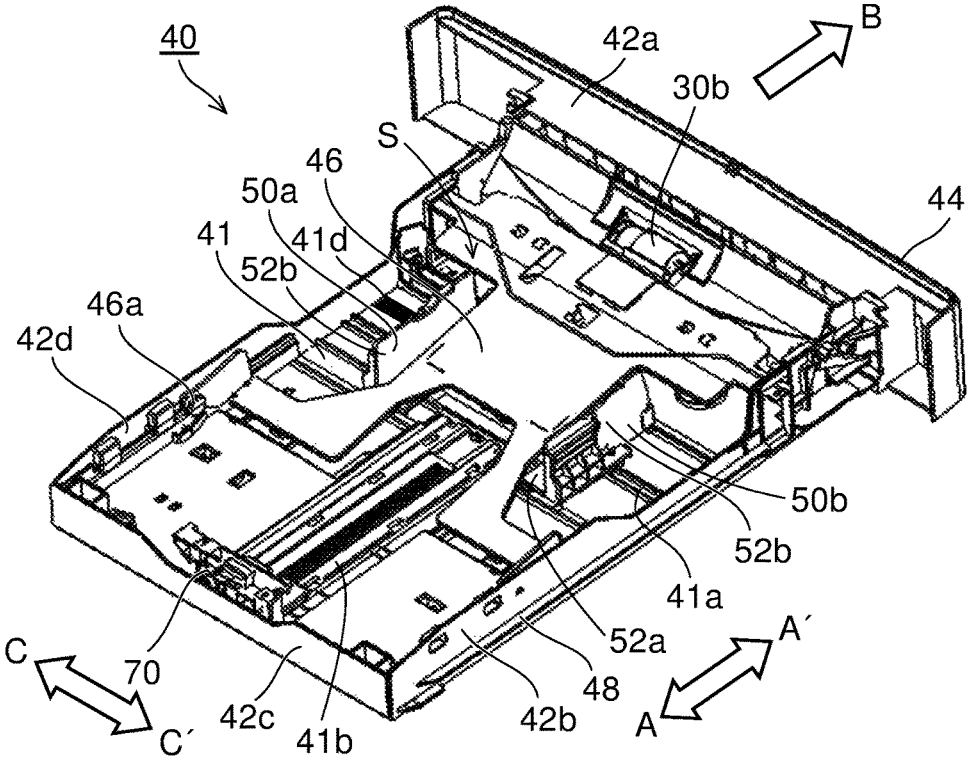
FIG. 2 is a perspective view showing the structure of the paper feed cassette according to the first embodiment of the present disclosure.

The configuration of the paper feed cassette 40 will then be described. FIG. 2 is a perspective view showing the structure of the paper feed cassette 40 according to the first embodiment of the present disclosure. In FIG. 2, the direction of insertion of the paper feed cassette 40 with respect to the main body of the image forming apparatus 100 is indicated by an arrow A, the direction of removal is indicated by an arrow A' and the direction of paper feed of the paper feed cassette 40 (sheet feeding direction) is indicated by an arrow B. A direction in which the regulation portion 52*b* of a width adjustment cursor 50*a* described later is moved away from the side ends (end edge) of the sheets 26 is indicated by an arrow C, and a direction in which the regulation portion 52*b* is moved close thereto is indicated by an arrow C'.

The paper feed cassette 40 is formed so as to be able to be fitted and removed with respect to a cassette fitting portion 1 (see FIG. 1) in the main body of the image forming apparatus 100. As shown in FIG. 2, in the paper feed cassette 40, side walls 42*a* to 42*d* are provided so as to stand on the peripheral portion of a bottom surface portion 41, the paper feed cassette 40 is formed in the shape of a flat box with its upper surface opened and the sheets 26 are stacked from the direction of the upper surface so as to be stored. A sheet storage portion S which stores the sheets 26 is formed with the bottom surface portion 41 and the side walls 42*a* to 42*d*.

On the side wall 42*a* on the upstream side in the direction of insertion of the paper feed cassette 40, a cassette cover 44 is fitted. The front surface of the cassette cover 44 is exposed to the outside so as to form part of the exterior surface of the main body of the image forming apparatus 100 (see FIG. 1).

In the sheet stacking plate 46 on which the sheets 26 (see FIG. 1) are stacked, swing shafts 46*a* on the left and right side on the upstream side in the direction of paper feed (the left front side of FIG. 2) serve as support points, and the end portion on the downstream side in the direction of paper feed (the right back side of FIG. 2) is provided so as to be able to be raised and lowered in an up/down direction by a coil spring (unillustrated) with respect to the bottom surface portion 41. On both sides in the direction of the width of the sheet stacking plate 46 (the direction perpendicular to the direction of paper feed, the direction of the arrows CC'), a pair of width adjustment cursors 50*a* and 50*b* for locating the sheets 26 in the direction of the width of the sheets 26 stacked on the sheet stacking plate 46 are provided so as to be able to reciprocate along a guide groove 41*a* formed in the bottom surface portion 41 in the sheet width direction (the direction of the arrows CC'). Since the sheet 26 is fed out toward the sheet transport path 4 (see FIG. 1) in the direction of the arrow B, a back end cursor 70 for aligning the back ends of the sheets 26 is provided so as to be able to reciprocate along a guide groove 41*b* formed in the bottom surface portion 41 parallel to the direction of paper feed (the direction of the arrow B). The width adjustment cursor 50*a* is an example of a "cursor" in the present disclosure.

The width adjustment cursors 50*a* and 50*b* and the back end cursor 70 are moved according to the size of the sheets stacked so as to store the sheets 26 in a predetermined position within the paper feed cassette 40.

On the outsides of the side walls 42*b* and 42*d* parallel to the direction of insertion or removal of the paper feed cassette 40 (the direction of the arrows AA'), guide rails 48 are additionally provided. On the side of the main body of the image forming apparatus 100, a rail support portion (unillustrated) which slidably supports the guide rails 48 is provided, the guide rails 48 are made to slide along the rail support portion and thus it is possible to insert and remove the paper feed cassette 40 with respect to the main body of the image forming apparatus 100.

In a center portion of a transport guide formed along the side wall 42*a* in the sheet width direction, the retard roller 30*b* is arranged, and when the paper feed cassette 40 is fitted to the main body of the image forming apparatus 100, the feed roller 30*a* on the side of the main body of the image forming apparatus 100 and the retard roller 30*b* on the side of the paper feed cassette 40 are brought into contact with each other so as to form the paper feed roller pair 30.

Figure 3:
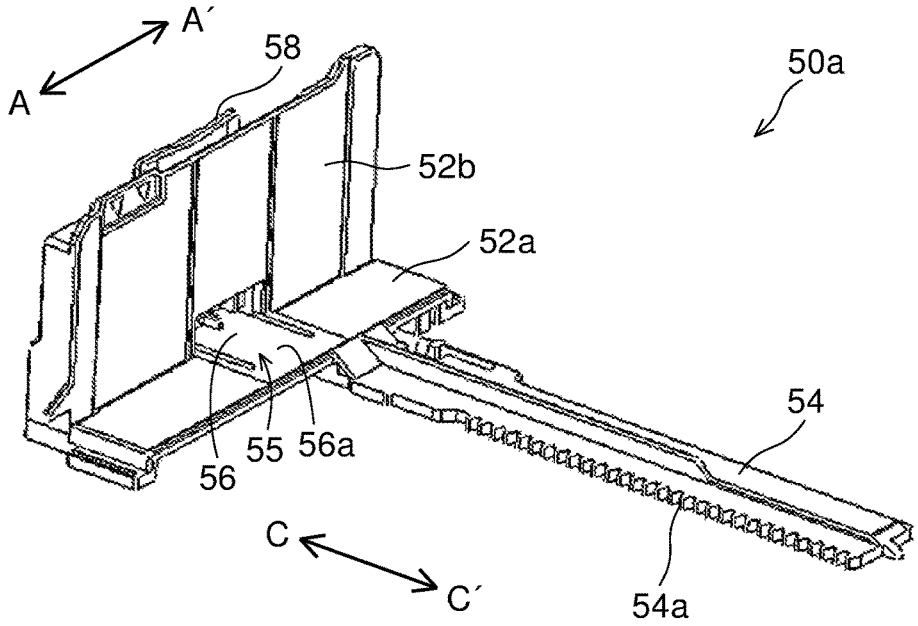
FIG. 3 is a perspective view showing the structure of a width adjustment cursor 50*a* in the paper feed cassette according to the first embodiment of the present disclosure.

Each of the width adjustment cursors 50*a* and 50*b* includes, as shown in FIGS. 2 and 3, a cursor main body 52*a* which is parallel to the bottom surface portion 41 and on which the end portions of the sheets 26 in the width direction are stacked and the regulation portion 52*b* which is provided so as to stand from the cursor main body 52*a* and which makes contact with the end edge (side ends) of the sheets 26 in the width direction. In each of the cursor main bodies 52*a*, a rack portion 54 is provided which is arranged within the bottom surface portion 41 and which is extended along the sheet width direction.

In the opposite surface of each of the rack portions 54 in the direction of the arrows AA', rack teeth 54*a* which are extended in the sheet width direction (the direction of the arrows CC') are formed. The rack teeth 54*a* in each of the rack portions 54 engage with the pinion teeth of a pinion gear (unillustrated) which is rotatably attached in a lower position of the sheet stacking plate 46 on the bottom surface portion 41. The rack portion 54 and the pinion gear (unillustrated) form a rack and pinion mechanism.

The pinion gear (unillustrated) can be rotated as the rack portion 54 is moved, and thus when the width adjustment cursor 50*a* (or 50*b*) on one side is moved in the sheet width direction, the pinion gear (unillustrated) is rotated, and accordingly, the width adjustment cursor 50*b* (or 50*a*) on the other side is moved in the opposite direction only by the same amount. In other words, the width adjustment cursors 50*a* and 50*b* are moved laterally symmetrically with respect to a center line in the sheet width direction.

Figure 4:
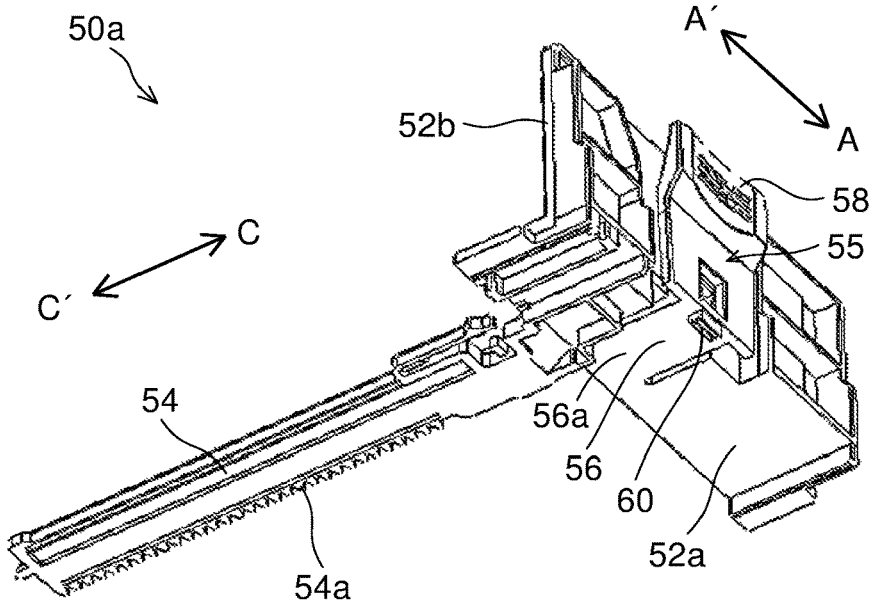
FIG. 4 is a perspective view showing, from below, the structure of the width adjustment cursor 50*a* in the paper feed cassette according to the first embodiment of the present disclosure.

Here, in the present embodiment, as shown in FIGS. 3 and 4, on the lower surface of the cursor main body 52*a* in the width adjustment cursor on one side (here, the width adjustment cursor 50*a*), a lock portion 55 is provided.

Figure 5:
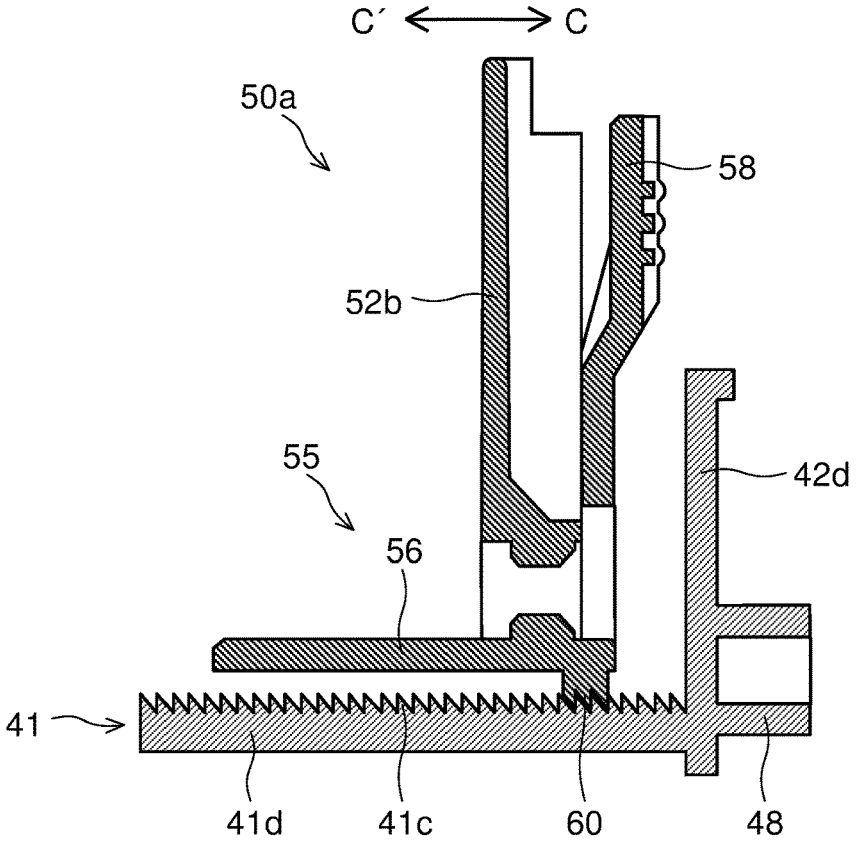
FIG. 5 is a cross-sectional view showing the structure of the lock portion of the width adjustment cursor and the vicinity of a rack in the paper feed cassette according to the first embodiment of the present disclosure.

The lock portion 55 is formed with a connection piece 56, a lever portion 58 and engagement protrusions 60. An end portion (one end portion) of the connection piece 56 inward in the sheet width direction (the direction of the arrow C') is connected to the cursor main body 52*a*, and is formed integrally of a resin. The connection piece 56 includes a connection portion 56*a* which is connected to the cursor main body 52*a*, and can be elastically deformed in an up/down direction with the connection portion 56*a* serving as a support point. On the lowermost surface of the connection piece 56, as shown in FIGS. 4 and 5, a plurality of (here, three) engagement protrusions 60 which are protruded downward are formed. In the bottom surface portion 41, a fixed rack 41*d* is provided which is extended in the sheet width direction, and which includes a plurality of fixed rack teeth 41*c* that engage with the engagement protrusions 60. The width adjustment cursor 50*a* can be moved along the fixed rack 41*d*. The fixed rack teeth 41*c* and the fixed rack 41*d* are respectively an example of "rack teeth" and an example of a "rack" in the present disclosure.

On the end portion (the other end portion) of the connection piece 56 outward in the sheet width direction (the direction of the arrow C, a first direction), the lever portion 58 which is extended upward and which is opposite the outside of the regulation portion 52*b* in the sheet width direction is integrally formed. The lever portion 58 is pressed inward in the sheet width direction (the direction of the arrow C'), and thus the connection piece 56 is elastically deformed upward, with the result that the engagement of the engagement protrusions 60 and the fixed rack 41*d* is cancelled.

Figure 6:
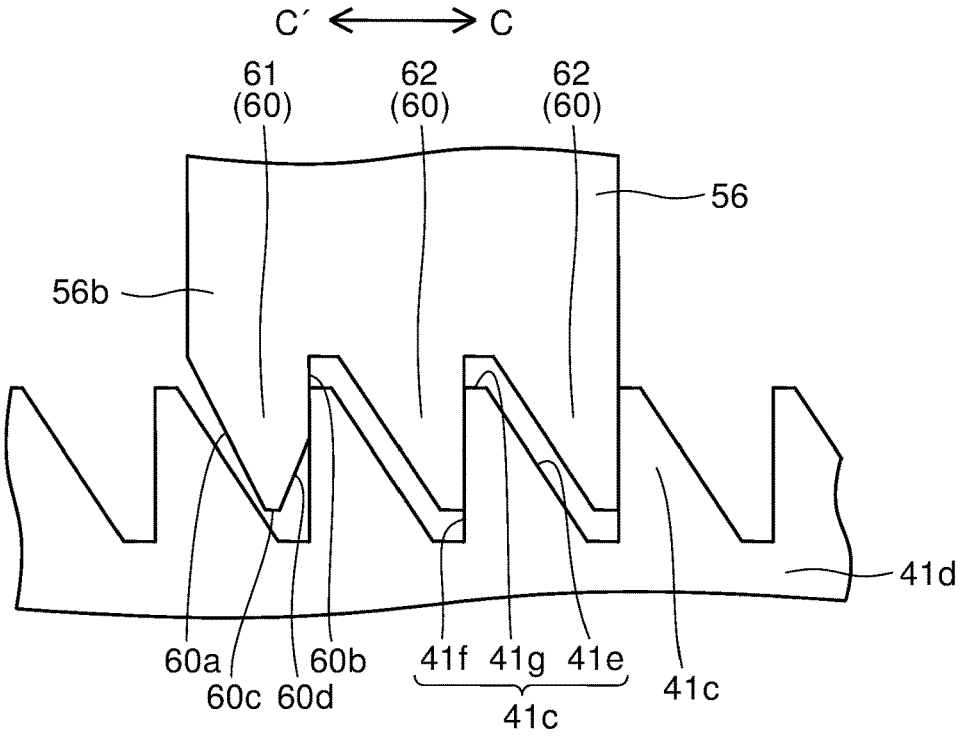
FIG. 6 is an enlarged cross-sectional view showing the structure of the engagement protrusions of the width adjustment cursor and rack teeth in the paper feed cassette according to the first embodiment of the present disclosure.
Figure 7:
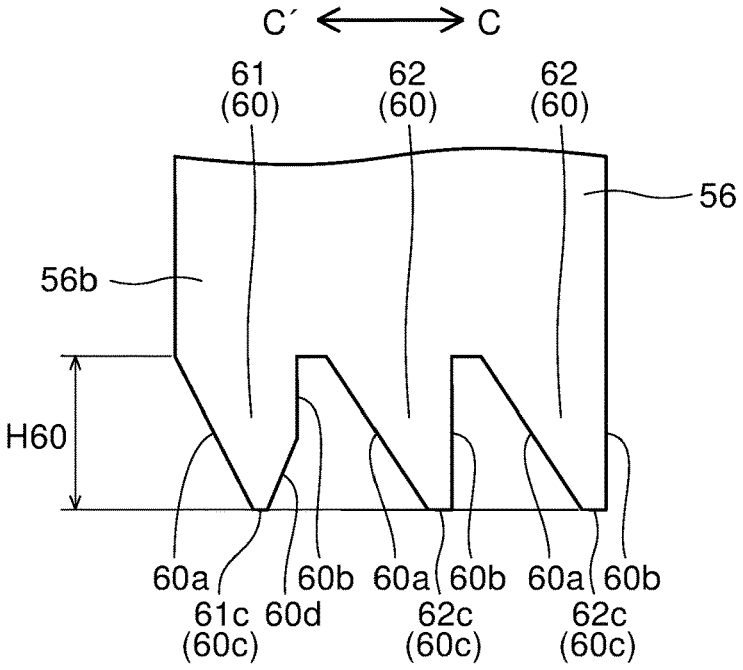
FIG. 7 is an enlarged cross-sectional view showing the structure of the engagement protrusions of the width adjustment cursor in the paper feed cassette according to the first embodiment of the present disclosure.

As shown in FIGS. 6 and 7, a plurality of engagement protrusions 60 are continuously provided with a predetermined pitch in the sheet width direction (the direction of the arrows CC'). Each of the engagement protrusions 60 includes: a second inclination surface 60*a* which is inclined from a base portion 56*b* toward a tip end portion in a direction (the direction of the arrow C, the first direction) extending from the side ends of the sheets 26 toward the regulation portion 52*b*; a second vertical surface 60*b* which is arranged with respect to the second inclination surface 60*a* in the direction of the arrow C and which is extended from the base portion 56*b* toward the tip end portion in a vertically downward direction; and a tip end surface 60*c* which is arranged between the second inclination surface 60*a* and the second vertical surface 60*b*, which is provided in the tip end portion of the engagement protrusion 60 and which is extended in a horizontal direction. In the present embodiment, all the amounts of protrusion H60 of the engagement protrusions 60 downward from the base portion 56*b* are the same, and thus in a horizontal state (the state of FIGS. 6 and 7) where the connection piece 56 of the lock portion 55 is not elastically deformed, all the positions of the heights of the tip end surfaces 60*c* are the same.

The fixed rack teeth 41*c* in the fixed rack 41*d* are continuously provided with the same pitch (the predetermined pitch) as the engagement protrusions 60 in the sheet width direction (the first direction). Each of the fixed rack teeth 41*c* includes: a first inclination surface 41*e* which is inclined from a tooth tip toward a tooth bottom in the direction (the direction of the arrow C, the first direction) extending from the side ends of the sheets 26 toward the regulation portion 52*b*; a first vertical surface 41*f* which is arranged with respect to the first inclination surface 41*e* in the direction of the arrow C' (second direction) and which is extended from the tooth bottom toward the tooth tip in a vertically upward direction; and an upper surface 41*g* which is arranged between the first inclination surface 41*e* and the first vertical surface 41*f*, which is provided at the upper end of the first vertical surface 41*f* in the fixed rack teeth 41*c* and which is extended in the horizontal direction. In other words, each of the fixed rack teeth 41*c* is a sawtooth whose tooth tip is formed with the first inclination surface 41*e* and the first vertical surface 41*f*. The second vertical surface 60*b* of the engagement protrusion 60 engages with the first vertical surface 41*f* of the fixed rack teeth 41*c*, and thus the movement of the width adjustment cursor 50*a* outward in the sheet width direction (the direction of the arrow C) is regulated. All the fixed rack teeth 41*c* are formed so as to have the same size and shape.

A plurality of engagement protrusions 60 include one first engagement protrusion 61 in which a third inclination surface 60*d* is formed and two second engagement protrusions 62 in which the third inclination surface 60*d* is not formed. Among the engagement protrusions 60, the first engagement protrusion 61 is arranged closest to the side of the connection portion 56*a*. The third inclination surface 60*d* of the first engagement protrusion 61 is arranged with respect to the second inclination surface 60*a* in the direction of the arrow C, is inclined downward in the direction of the arrow C' (the second direction) and is extended to the tip end portion of the engagement protrusion 60. The third inclination surface 60*d* is extended from the lower end of the second vertical surface 60*b* so as to connect together the tip end surface 60*c* and the second vertical surface 60*b*. As shown in FIG. 7, the length of a first tip end surface 61*c* of the first engagement protrusion 61 in the direction of the arrow C is shorter than the length of a second tip end surface 62*c* of the second engagement protrusion 62 in the direction of the arrow C.

In the paper feed cassette 40, the sheets 26 are stored in the sheet storage portion S, the width adjustment cursor 50*a* is brought into contact with the side ends of the sheets 26 in a state where the lever portion 58 is operated so as to elastically deform the connection piece 56 of the lock portion 55 upward, thereafter the operation of the lever portion 58 is cancelled such that the connection piece 56 is returned to the horizontal state and thus the engagement protrusions 60 engage with the fixed rack teeth 41*c*, with the result that it is possible to align the sheets 26 in the width direction.

Figure 8:
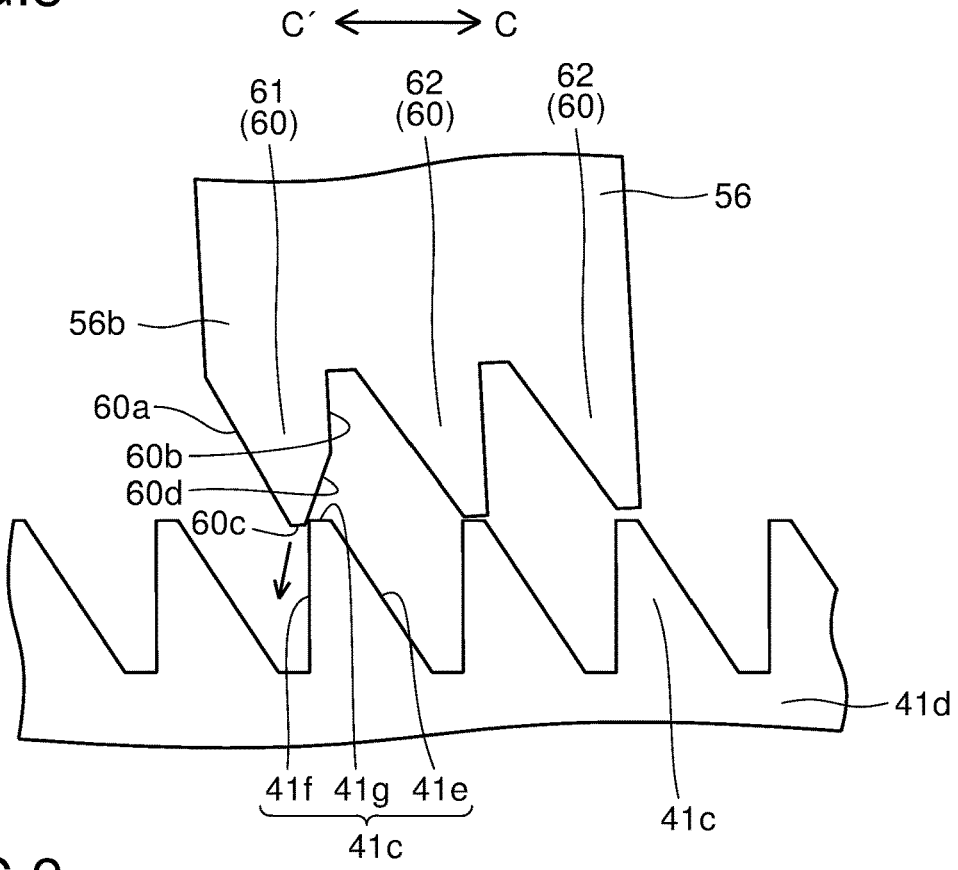
FIG. 8 is an enlarged cross-sectional view showing the structure of the engagement protrusions of the width adjustment cursor and the rack teeth in the paper feed cassette according to the first embodiment of the present disclosure and shows a state where the cursor is slightly moved by the pressure of sheets in the direction of an arrow C.

Here, since the connection piece 56 is elastically deformed in the up/down direction with the connection portion 56*a* serving as the support point, in the state where the connection piece 56 is elastically deformed upward, among the engagement protrusions 60, the first engagement protrusion 61 arranged closest to the side of the connection portion 56*a* is arranged lower than the other engagement protrusions 60 (the second engagement protrusions 62). In this way, when the connection piece 56 is returned to the horizontal state, the first engagement protrusion 61 first engages with the fixed rack teeth 41*c*. Hence, as shown in FIG. 8, even when the operation of the lever portion 58 is cancelled, and the width adjustment cursor 50*a* is slightly moved by the pressure of the sheets 26 in the direction of the arrow C (in the direction away from the sheets 26), the third inclination surface 60*d* of the first engagement protrusion 61 is guided to the fixed rack teeth 41*c*, and thus the engagement protrusions 60 are fitted between the fixed rack teeth 41*c* while being moved in the direction of the arrow C'. Hence, the engagement protrusions 60 engage in the desired position of the fixed rack 41*d*.

In the present embodiment, as described above, the first engagement protrusion 61 includes the third inclination surface 60*d* which is arranged with respect to the second inclination surface 60*a* in the direction of the arrow C, which is inclined downward in the direction of the arrow C' and which is extended to the tip end portion of the engagement protrusion 60. In this way, even when the width adjustment cursor 50*a* is brought into contact with the side ends of the sheets 26 in the state where the lever portion 58 is operated, and thereafter the width adjustment cursor 50*a* is moved by the pressure of the sheets 26 in the direction of the arrow C (the direction away from the sheets 26) at the time of cancellation of the operation of the lever portion 58, the third inclination surface 60*d* of the engagement protrusion 60 engages with the fixed rack teeth 41*c*, and the engagement protrusion 60 is moved downward while being moved (returned) in the direction of the arrow C'. Hence, the engagement protrusion 60 engages in the desired position of the fixed rack 41*d*, and thus it is possible to reduce the displacement of the side ends of the sheets 26.

As described above, the third inclination surface 60*d* is provided in the engagement protrusion 60 (the first engagement protrusion 61) which is arranged closest to the side of the connection portion 56*a*. When the connection piece 56 of the lock portion 55 is provided so as to be able to be elastically deformed in the up/down direction with the connection portion 56*a* serving as the support point, the engagement protrusion 60 (the first engagement protrusion 61) arranged closest to the side of the connection portion 56*a* first engages with the fixed rack teeth 41*c*. Hence, the third inclination surface 60*d* can be made to reliably engage with the fixed rack teeth 41*c*, and thus it is possible to reliably reduce the displacement of the side ends of the sheets 26.

As described above, the engagement protrusions 60 include the first engagement protrusion 61 with the third inclination surface 60*d* and the second engagement protrusions 62 without the third inclination surface 60*d*. In this way, the second vertical surface 60*b* of the second engagement protrusion 62 is prevented from being narrow (short in the up/down direction), and thus it is possible to acquire the engagement area of the second vertical surface 60*b* and the first vertical surface 41*f* of the fixed rack teeth 41*c*.

As described above, the length of the first tip end surface 61*c* of the first engagement protrusion 61 in the direction of the arrow C is shorter than the length of the second tip end surface 62*c* of the second engagement protrusion 62 in the direction of the arrow C. In this way, it is possible to reduce the arrangement of the first tip end surface 61*c* of the first engagement protrusion 61 on the fixed rack teeth 41*c*. In other words, the third inclination surface 60*d* easily engages with the fixed rack teeth 41*c*, and thus it is possible to more reduce the displacement of the side ends of the sheets 26.

As described above, the third inclination surface 60*d* is arranged between the second inclination surface 60*a* and the second vertical surface 60*b*. In other words, even in the first engagement protrusion 61, the second vertical surface 60*b* is provided. In this way, it is possible to easily increase the engagement area of the second vertical surface 60*b* and the first vertical surface 41*f* of the fixed rack teeth 41*c*.

As described above, at the end portion of the connection piece 56 in the direction of the arrow C, the lever portion 58 is provided which is extended upward and which is opposite the regulation portion 52*b* in the direction of the arrow C. In this way, the lever portion 58 is pressed toward the regulation portion 52*b*, and thus it is possible to easily elastically deform the connection piece 56 upward.

Second Embodiment

Figure 9:
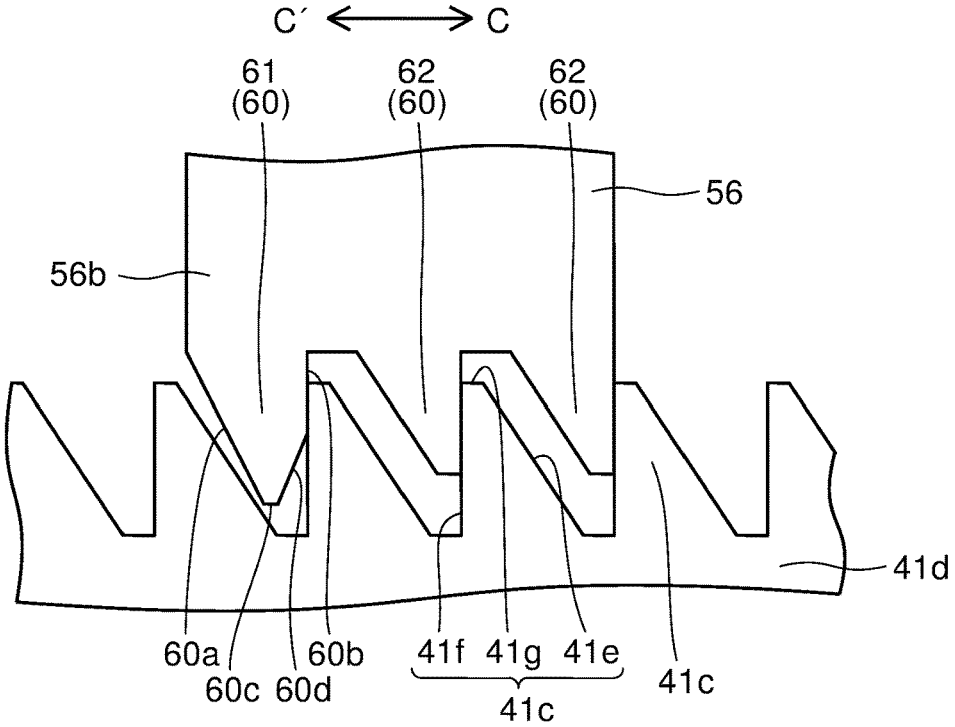
FIG. 9 is an enlarged cross-sectional view showing the structure of the engagement protrusions of a width adjustment cursor and rack teeth in a paper feed cassette according to a second embodiment of the present disclosure.
Figure 10:
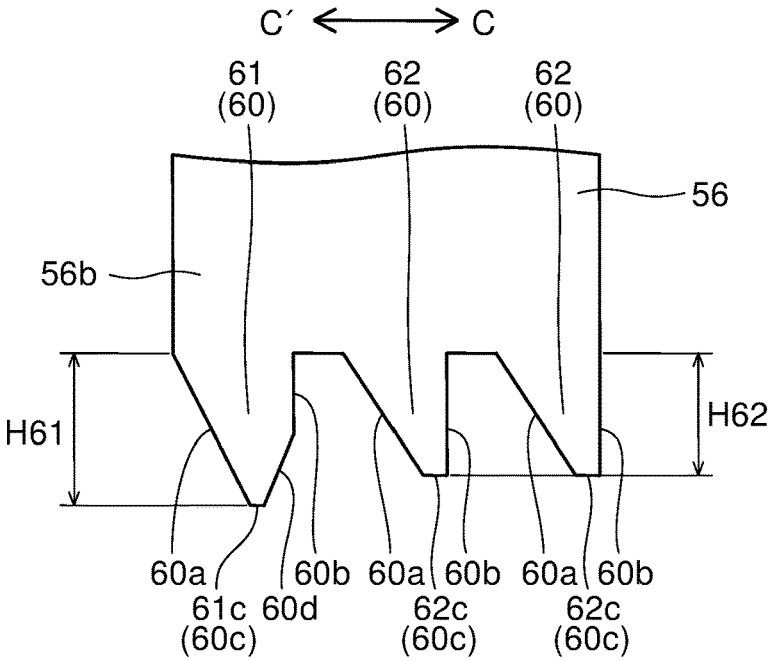
FIG. 10 is an enlarged cross-sectional view showing the structure of the engagement protrusions of the width adjustment cursor in the paper feed cassette according to the second embodiment of the present disclosure.

In a paper feed cassette 40 according to a second embodiment of the present disclosure, as shown in FIGS. 9 and 10, the amount H61 of protrusion of the first engagement protrusion 61 downward is greater than the amount H62 of protrusion of the second engagement protrusions 62 downward. Hence, in the horizontal state (the state of FIGS. 9 and 10) where the lock portion 55 is not elastically deformed, the first tip end surface 61*c* of the first engagement protrusion 61 is arranged lower than the second tip end surface 62*c* of the second engagement protrusions 62.

Figure 11:
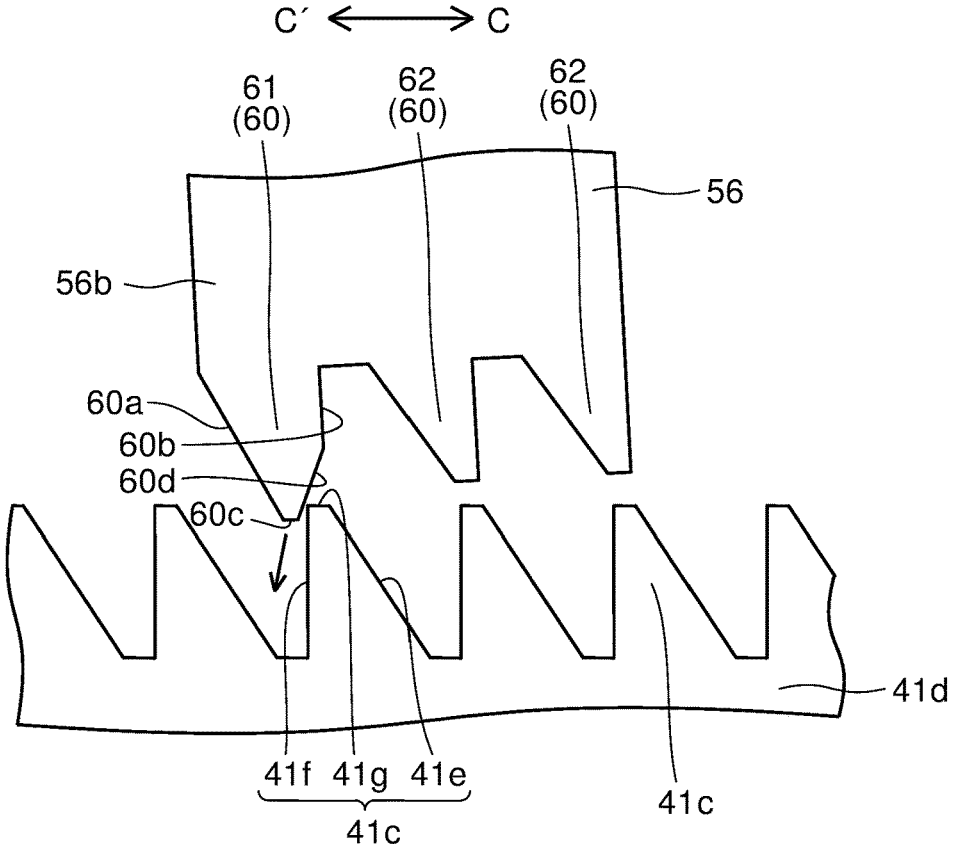
FIG. 11 is an enlarged cross-sectional view showing the structure of the engagement protrusions of the width adjustment cursor and the rack teeth in the paper feed cassette according to the second embodiment of the present disclosure and shows a state where the width adjustment cursor is slightly moved by the pressure of the sheets in the direction of an arrow C.

In the paper feed cassette 40 described above, even when the width adjustment cursor 50*a* is brought into contact with the side ends of the sheets 26 in the state where the lever portion 58 is operated so as to elastically deform the lock portion 55 upward, and thereafter the width adjustment cursor 50*a* is slightly moved by the pressure of the sheets 26 in the direction of the arrow C (the direction away from the sheets 26) at the time of cancellation of the operation of the lever portion 58, as shown in FIG. 11, the third inclination surface 60*d* of the first engagement protrusion 61 more reliably engages with the fixed rack teeth 41*c* before the second engagement protrusions 62 engage therewith.

The other structures in the second embodiment are the same as in the first embodiment described above.

In the present embodiment, as described above, the first engagement protrusion 61 is formed so as to be protruded lower than the second engagement protrusions 62. In this way, the first engagement protrusion 61 can be made to reliably and first engage with the fixed rack teeth 41*c*, and thus the third inclination surface 60*d* can be made to more reliably engage with the fixed rack teeth 41*c*. Hence, it is possible to more reliably reduce the displacement of the side ends of the sheets 26.

The other effects in the second embodiment are the same as in the first embodiment described above.

The embodiments disclosed here should be considered to be illustrative in all respects and not restrictive. The scope of the present disclosure is indicated not by the description of the embodiments discussed above but by the scope of claims, and meanings equivalent to the scope of claims and all modifications within the scope are further included.

For example, although in the embodiments discussed above, the example where the lock portion 55 having the engagement protrusions 60 is provided only in the width adjustment cursor on one side (the width adjustment cursor 50*a*) is described, the present disclosure is not limited to this example. The lock portions 55 may be provided both in the width adjustment cursors 50*a* and 50*b*. By providing the lock portion 55 in the back end cursor 70, the displacement of the back ends (end edge) of the sheets 26 may be reduced.

Although in the embodiments discussed above, the example where the first engagement protrusion 61 having the third inclination surface 60*d* is arranged closest to the side of the connection portion 56*a* is described, the present disclosure is not limited to this example. The first engagement protrusion 61 may be arranged in a position other than the position closest to the side of the connection portion 56*a*. In this case, the amount of protrusion downward is preferably increased such that the first engagement protrusion 61 having the third inclination surface 60*d* first engages with the fixed rack teeth 41*c*. The third inclination surfaces 60*d* may be provided in all the engagement protrusions 60.

Although in the embodiments discussed above, the example where the tip end surface 60*c* which is extended in the horizontal direction is provided in the engagement protrusion 60 is described, the present disclosure is not limited to this example, and the tip end surface 60*c* which is extended in the horizontal direction does not need to be provided in the engagement protrusion 60.

Although in the embodiments discussed above, the example where a plurality of (here, three) engagement protrusions 60 are provided is described, the present disclosure is not limited to this example, and only one engagement protrusion 60 may be provided.

Although in the embodiments discussed above, the example where the second vertical surface 60*b* which is extended in the vertically downward direction is provided in the first engagement protrusion 61 is described, the present disclosure is not limited to this example, and the second vertical surface 60*b* does not need to be provided in the first engagement protrusion 61. However, when only one engagement protrusion 60 is provided in the lock portion 55, the second vertical surface 60*b* needs to be provided in the engagement protrusion 60.

Configurations obtained by combining the configurations of the embodiments and variations described above as necessary are also included in the technical scope of the present disclosure.

What is claimed is:

1. A sheet storage cassette which can be inserted and removed with respect to a cassette fitting portion in a main body of an apparatus, the sheet storage cassette comprising:

a sheet storage portion which stores sheets;

a sheet stacking plate which is provided in the sheet storage portion so as to be pivoted with a portion on an upstream side in a sheet feeding direction serving as a support point;

a rack which is provided on a bottom surface of the sheet storage portion and which is extended along a first direction; and a cursor which can be moved along the rack and which makes contact with an end edge of the sheets in the first direction so as to align the sheets, wherein the rack includes rack teeth which are continuously provided with a predetermined pitch in the first direction, each of the rack teeth includes a first vertical surface which is extended vertically upward from a tooth bottom toward a tooth tip and a first inclination surface which is inclined from the tooth tip toward the tooth bottom in the first direction, the cursor includes a cursor main body, a regulation portion which makes contact with the end edge of the sheets and a lock portion provided on a lower surface of the cursor main body, the lock portion includes at least one engagement protrusion that engages with the rack teeth and which regulates a movement of the cursor, the at least one engagement protrusion each includes a second inclination surface which is inclined from a tip end portion toward a base portion in a second direction opposite to the first direction, at least one of the at least one engagement protrusion includes a second vertical surface which is extended vertically downward from the base portion toward the tip end portion, the second vertical surface engages with the first vertical surface such that the movement of the cursor in the first direction is regulated and at least one of the at least one engagement protrusion includes, between the base portion and the tip end portion, a third inclination surface which is inclined in the second direction from the second vertical surface and extended to the tip end portion of the at least one engagement protrusion.

2. An image forming apparatus comprising the sheet storage cassette according to claim 1 and an image formation portion.

3. A sheet storage cassette which can be inserted and removed with respect to a cassette fitting portion in a main body of an apparatus, the sheet storage cassette comprising:

a sheet storage portion which stores sheets;

a sheet stacking plate which is provided in the sheet storage portion so as to be pivoted with a portion on an upstream side in a sheet feeding direction serving as a support point;

a rack which is provided on a bottom surface of the sheet storage portion and which is extended along a first direction; and a cursor which can be moved along the rack and which makes contact with an end edge of the sheets in the first direction so as to align the sheets, wherein the rack includes rack teeth which are continuously provided with a predetermined pitch in the first direction, each of the rack teeth includes a first vertical surface which is extended vertically upward from a tooth bottom toward a tooth tip and a first inclination surface which is inclined from the tooth tip toward the tooth bottom in the first direction, the cursor includes a cursor main body, a regulation portion which makes contact with the end edge of the sheets and a lock portion provided on a lower surface of the cursor main body, the lock portion includes at least one engagement protrusion that engages with the rack teeth and which regulates a movement of the cursor, the at least one engagement protrusion each includes a second inclination surface which is inclined from a tip end portion toward a base portion in a second direction opposite to the first direction, at least one of the at least one engagement protrusion includes a second vertical surface which is extended vertically downward from the base portion toward the tip end portion, the second vertical surface engages with the first vertical surface such that the movement of the cursor in the first direction is regulated, at least one of the at least one engagement protrusion includes a third inclination surface which is inclined in the second direction and extended to the tip end portion of the at least one engagement protrusion, the lock portion includes a connection piece and a lever portion, the connection piece has one end portion connected to the cursor main body and is provided so as to be extended outward of the regulation portion in the first direction, the lever portion is provided so as to be extended upward from the other end portion of the connection piece, the at least one engagement protrusion includes a plurality of the engagement protrusions in the lock portion, the plurality of the engagement protrusions are arranged along the first direction and the third inclination surface is provided in at least the engagement protrusion of the engagement protrusions which is arranged closest to a side of the second direction.

4. An image forming apparatus comprising the sheet storage cassette according to claim 3 and an image formation portion.

5. A sheet storage cassette which can be inserted and removed with respect to a cassette fitting portion in a main body of an apparatus, the sheet storage cassette comprising:

a sheet storage portion which stores sheets;

a sheet stacking plate which is provided in the sheet storage portion so as to be pivoted with a portion on an upstream side in a sheet feeding direction serving as a support point;

a rack which is provided on a bottom surface of the sheet storage portion and which is extended along a first direction; and a cursor which can be moved along the rack and which makes contact with an end edge of the sheets in the first direction so as to align the sheets, wherein the rack includes rack teeth which are continuously provided with a predetermined pitch in the first direction, each of the rack teeth includes a first vertical surface which is extended vertically upward from a tooth bottom toward a tooth tip and a first inclination surface which is inclined from the tooth tip toward the tooth bottom in the first direction, the cursor includes a cursor main body, a regulation portion which makes contact with the end edge of the sheets and a lock portion provided on a lower surface of the cursor main body, the lock portion includes at least one engagement protrusion that engages with the rack teeth and which regulates a movement of the cursor, the at least one engagement protrusion each includes a second inclination surface which is inclined from a tip end portion toward a base portion in a second direction opposite to the first direction, at least one of the at least one engagement protrusion includes a second vertical surface which is extended vertically downward from the base portion toward the tip end portion, the second vertical surface engages with the first vertical surface such that the movement of the cursor in the first direction is regulated, at least one of the at least one engagement protrusion includes a third inclination surface which is inclined in the second direction and extended to the tip end portion of the at least one engagement protrusion and the at least one engagement protrusion includes engagement protrusions, the engagement protrusions include a first engagement protrusion with the third inclination surface and a second engagement protrusion without the third inclination surface.

6. The sheet storage cassette according to claim 5, wherein the first engagement protrusion is formed so as to be protruded tower than the second engagement protrusion.

7. The sheet storage cassette according to claim 5, wherein a first tip end surface extending horizontally in the first direction is formed on a tip end portion of the first engagement protrusion and a second tip end surface extending horizontally in the first direction is formed on a tip end portion of the second engagement protrusion, and a length of the first tip end surface is shorter than a length of the second tip end surface.

8. The sheet storage cassette according to claim 5, wherein the lock portion includes a connection piece and a lever portion, the connection piece has one end portion connected to the cursor main body and is provided so as to be extended outward of the regulation portion in the first direction and the lever portion is provided so as to be extended upward from the other end portion of the connection piece, the connection piece can be pivoting about the one end portion in a vertical direction and when the cursor is locked in a predetermined position, the engagement protrusions are moved from a retraction position where the engagement protrusions are retracted above the rack to an engagement position where the engagement protrusions engage with the rack by an operation of the lever portion, and the third inclination surface makes contact with one of the tooth tips of the rack teeth such that the first engagement protrusion is moved along a direction of the inclination of the third inclination surface so as to engage with the rack teeth.

9. An image forming apparatus comprising the sheet storage cassette according to claim 5 and an image formation portion.

* * * * *